United States Patent [19]

Baus

[11] Patent Number: 4,914,770

[45] Date of Patent: Apr. 10, 1990

[54] SHOWER-PARTITION

[75] Inventor: Heinz G. Baus, Hünibach-Thun, Switzerland

[73] Assignee: Altura Leiden Holding B.V., Maastricht, Netherlands

[21] Appl. No.: 178,020

[22] Filed: Apr. 5, 1988

[30] Foreign Application Priority Data

Apr. 7, 1987 [DE] Fed. Rep. of Germany ..... 3711609

[51] Int. Cl.[4] ..... A47K 3/22

[52] U.S. Cl. ..... 4/612; 4/614; 4/596; 52/239

[58] Field of Search ..... 4/596, 612, 614, 584, 4/613, 609, 610; 52/34, 35, 235, 239, 276–283, 288; 211/87, 88, 90; 248/208, 236, 220.1, 231.91, 222.4, 244

[56] References Cited

U.S. PATENT DOCUMENTS

| | | | |
|---|---|---|---|
| 1,604,810 | 10/1926 | Christ . | |
| 2,828,044 | 3/1958 | Reiss et al. | 248/220.1 |
| 4,070,835 | 1/1978 | Revèrend et al. | 52/235 |
| 4,073,107 | 2/1978 | Rousseau | 52/235 |
| 4,109,426 | 8/1978 | Dobija | 52/35 |
| 4,131,970 | 1/1979 | Le Van | 49/141 |
| 4,434,900 | 3/1984 | Cook | 211/189 |
| 4,708,310 | 11/1987 | Smith | 248/220.1 |
| 4,720,876 | 1/1988 | Tomei et al. | 4/612 |

FOREIGN PATENT DOCUMENTS

| | | | |
|---|---|---|---|
| 3022271 | 1/1982 | Fed. Rep. of Germany | 4/596 |
| 3326790 | 2/1984 | Fed. Rep. of Germany . | |
| 8408029.9 | 6/1984 | Fed. Rep. of Germany . | |
| 3104222 | 10/1987 | Fed. Rep. of Germany . | |
| 2436868 | 4/1980 | France | 4/614 |

*Primary Examiner*—Henry J. Recla
*Assistant Examiner*—Edward C. Donovan
*Attorney, Agent, or Firm*—Foley & Lardner, Schwartz, Jeffery, Schwaab, Mack, Blumenthal & Evans

[57] ABSTRACT

A shower-partition comprising a wall-element consisting, more particularly, of an at least partly transparent material which is to be arranged against the wall of a room. The object is to provide, at a low structural cost, a stable attachment of the wall-element to the wall of the room, and the alignment of the wall-element in a simple manner. In order to accomplish this, the wall-element is secured to the stationary wall of the room by means of a crosspiece which comprises a first support-surface for the wall-element and a second support-surface for the wall of the room. The support-surfaces is preferably arranged at right angles to each other.

6 Claims, 5 Drawing Sheets

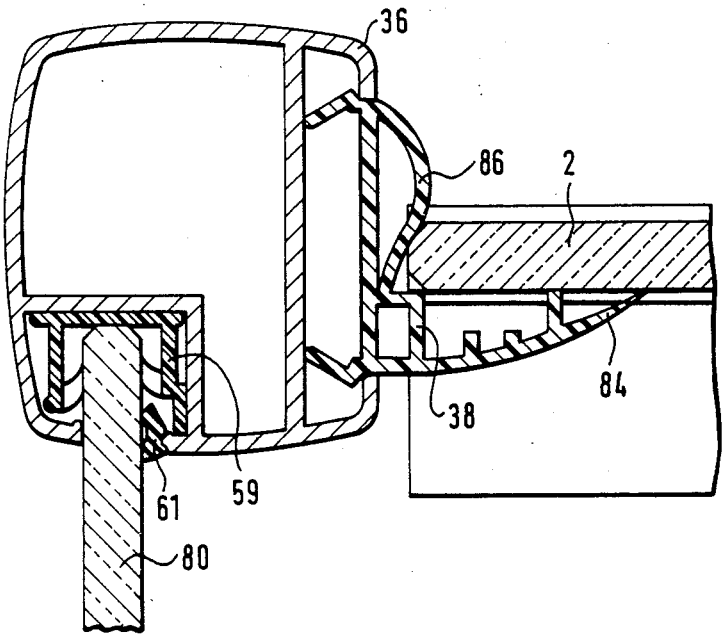
Fig. 5
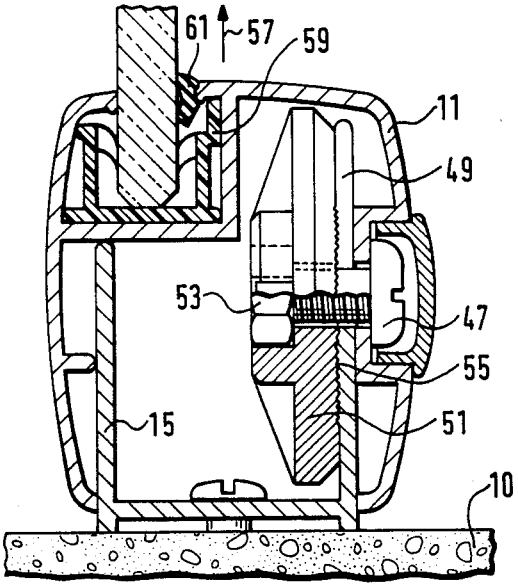

SHOWER-PARTITION

BACKGROUND OF THE INVENTION

1. Field of the invention

The present invention relates to a shower-partition comprising a wall-element, the shower-partition being adapted to be secured by means of the wall element to a wall of a room.

2. Description of the Prior Art

German No. OS 33 26 790 discloses a shower-partition having a wall-element made of glass which is secured to the wall of a room, at one vertical longitudinal edge by means of a frame-profiled rail. Provided at the other vertical longitudinal edge is a corner-profiled-rail which extends from the floor to the ceiling of the shower-room. The corner-profiled-rail is intended to provide stable attachment of the wall-element. Arranged at right angles to the wall element is a folding door, also made of glass, which is fitted to the other wall of the room by means of hinges and can therefore swing. A shower-partition of this kind is usually arranged in a corner between two walls in a room in such a manner that the wall-element and the door jointly enclose, with the walls of the room, a rectangular or square floor-area or shower-tub, with the corner-profiled-rail extending farthest into the shower-room. According to other designs, the folding door may be replaced by sliding doors made of a transparent material, more particularly glass. Such known shower-partition assumes secure anchorage of the corner-profiled-rail to the ceiling. In the case of a suspended ceiling such as is frequently present in older buildings with very high ceilings, it is not easy to secure a continuous corner-profiled-rail of this kind to the ceiling. Problems may also arise with wooden ceilings due to the lack of a beam above the corner-post to provide a stable attachment, making additional transverse struts, or the like, necessary, with a corresponding increase in assembly costs. In the case of rooms having ceilings of different heights, the corner-profiled-rail must be extended to the necessary length or additional extension-profiles or the like must be prepared. This results in an increase in production-costs and inventory.

German Registered Design No. 84 08 029 discloses a corner-connection for shower-partitions consisting of a rod-like corner-strut with two connecting pieces to be secured, on the one hand, to the wall of a room and, on the other hand, to a stationary wall-element of the shower-partition. The rod-shaped corner-strut is of circular or oval cross-section, the two connecting pieces being secured to the ends of the corner-strut by means of screws. The wall-element contains a frame made of four profiled rails arranged at right angles to each other, a plate made of a transparent plastic being inserted into this frame. The one connecting piece is placed at the top upon the upper frame-profiled-rail of the wall-element and is secured by means of screw. During assembly of the shower-partition, holes must be made in the upper profiled rail for the screws. If, during assembly, the distance between the wall-element and the wall of the room has to be altered, such holes must be made in situ and this may easily damage the profiled rail or even the whole wall-element. Since the corner-connection has several parts, this involves not inconsiderable production costs and there are limits to the load which can be carried by the thin, rod-shaped corner-strut. Additional problems arise in compensating for on-site tolerances, usually requiring the use of so-called compensating sections.

OBJECTS OF THE INVENTION

It is therefore an object of the invention to develop a shower-partition of the type mentioned at the beginning hereof, at low structural cost, in order to ensure, regardless of local conditions, simple assembly and, at the same time, stable and functional installation. Furthermore, anchorage of the wall-element is to be highly stable. It is to be possible to carry out assembly and adjustment of the wall-element, and of the complete shower-partition, with little handling and without special tools, bearing in mind that room-walls are often not exactly vertical. Moreover, the shower-partition is to be easily set up and adjusted in spite of on-site tolerances and of shower-rooms and shower-tubs of different widths. If the wall-element is made of glass, especially safety glass, stable and functional support of the wall-element is to be assured. No holes are to be made on-site in the glass wall-element during assembly. Inadmissible high surface-pressures, which very quickly lead to cracks and destruction of the wall-element, especially when the latter is made of glass, are to be definitely avoided.

SUMMARY OF THE INVENTION

According to the present invention there is therefore provided a shower-partition comprising a wall-element and adapted to be secured therebY to a wall of a room, said shower-partition further comprising:

a crosspiece comprising a first support-surface adapted to be secured to said wall-element, and a second support-surface adapted to be secured to said wall of the room.

Preferably, the first and the second surfaces are at right angles to each other and they are vertical.

According to a preferred embodiment, there is provided a shower-partition comprising a wall-element and adapted to be secured thereby to a wall of a room, said shower-partition further comprising:

a crosspiece having a horizontally arranged bottom-plate, and vertical edge-parts arranged upon the bottom-plate, a first of said edge-parts comprising a first vertical support-surface facing the wall-element, and a second of said edge-parts comprising a second vertical support surface facing the wall of the room, the wall-element comprising an elongated hole through which is passed a connecting element for connecting the wall-element to said crosspiece.

Preferably, instead of the wall-element it is the first edge-part which is provided with an elongated hole through which is passed a connecting element for connecting the wall-element to the crosspiece.

In an advantageous embodiment, both the wall-element and the first edge-part may be provided each with an elongated hole through which may be passed a connecting element for connecting the wall-element to the crosspiece.

The shower-partition proposed by the present invention is to be functional and inexpensive and is to ensure satisfactory stability of the wall-element while using only a small amount of material. The proposed crosspiece, which is fitted, preferably, to the upper part of the wall-element, is to be simple to produce and assemble and is to be able to withstand reliable loads applied at right angles to the vertical plane of the wall-element.

The first support-surface of the crosspiece lies against the wall-element preferably in a vertical plane, the size of this support-surface being predetermined by taking into account admissible surface-pressures. Especially in the case of a wall-element made of a sheet of glass, damage in the connecting area between the crosspiece and the sheet of glass is definitely avoided.

Preferably, the crosspiece is arranged at a predeterminable distance below the upper edge of the wall-element, so that making a hole, or an elongated hole, in the wall-element presents no problems, and there is no danger of damaging, or even cracking, the whole wall-element.

Preferably, the wall-element is in the form of a sheet of glass, and is inserted with its two vertical longitudinal edges into vertical profiled rails. A frame-profiled-rail adjacent the wall of the room, together with the sheet of glass, is adapted to be aligned horizontally, during assembly, in order to compensate for on-site inaccuracies and tolerances. This frame-profiled-rail, together with the sheet of glass, is thereafter secured, in relation to a second wall-profiled-rail, by means of an attachment element.

Assembly is substantially facilitated by connecting the crosspiece with the wall-element by means of the elongated hole. The first step in assembling is to connect the wall-profiled-rail and the crosspiece to the wall of the room in the usual manner, for example by means of dowels and corresponding screws. The wall-element may then be loosely connected, by the frame-profiled-rail, to the wall-profiled-rail and the wall-element may also be loosely connected to a transverse strut. The relatively heavy sheet of glass of the wall-element is therefore already secured during assembly by means of the transverse strut. The sheet of glass may thereafter be aligned, in relation to the wall of the room, by moving it, especially horizontally, tilting being prevented by the crosspiece. The crosspiece makes it possible for one person to assemble the relatively heavy sheet of glass.

The crosspiece is preferably arranged in the interior of the shower-partition and is therefore advantageously not visible from the outside. A long corner-profiled-rail extending to the ceiling is unnecessary. The crosspiece bears directly against the inside of the sheet of glass constituting the wall-element. If a corner-profiled-rail is provided, which extends only over the entire height of the shower-partition, such rail may be relatively thin, thus saving a not inconsiderable amount of material.

The crosspiece may be made of metal or plastic, preferably by injection-moulding. It preferably comprises a bottom-plate and is arranged in a substantially horizontal plane. It may also be designed as a receptacle for soap or the like. The horizontally arranged bottom-plate is preferably, surrounded by a peripheral edge running in the vertical direction and extending, in a horizontal plane, over the entire periphery of the crosspiece. In a vertical plane, therefore, the crosspiece exhibits a basically U-shaped cross-section but, by extending the edge in another direction, it is possible, within the scope of the invention, also to obtain an H-shaped cross-section. As a result of the U-shaped cross-section in particular, the crosspiece uses little material, is light and, in spite of the reduced thickness of both the bottom-plate and the surrounding edge, it exhibits considerable strength and rigidity.

Preferably, the first support-surface is substantially smaller in comparison with the overall length of the crosspiece, so that a free space is available towards the wall-element. There is also a certain amount of resiliency and flexibility in the wall-element and its mounting, whereas the crosspiece is relatively rigid. Bracing of the wall-element is unnecessary, especially since it can be arranged with resilient means against the wall of the room by means of the profiled rail.

As above mentioned, the crosspiece be advantageously connected to the wall-element in such a matter that the latter is adjustable in relation to the stationary wall and/or the crosspiece. To this end, the wall-element and/or the crosspiece are provided as above indicated with elongated holes. Depending upon the length of the holes, this permits relative movement between the wall-element and the crosspiece until secure attachment is assured, after suitable alignment, with screws or other means of attachment. Compensating for on-site tolerances presents no problems.

BRIEF DESCRIPTION OF THE DRAWINGS

A preferred embodiment will now be described, as example without limitative manner, having reference the attached drawings, wherein:

FIG. 5 is a cross-section along the line V—V in FIG. 1.

DESCRIPTION OF AN EXEMPLARY EMBODIMENT

Figure 1:
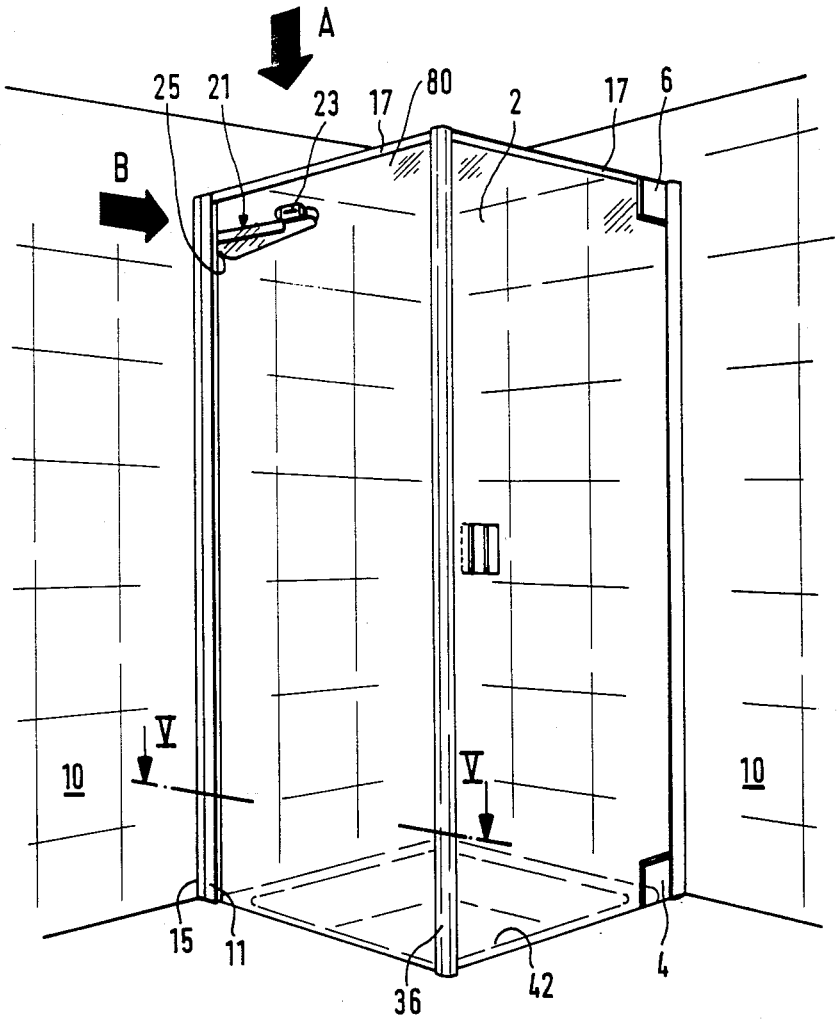
FIG. 1 is a diagrammatical view of the shower-partition.

Referring to the Figures, FIG. 1 shows a view of the shower-partition which is arranged over a shower-tub 42 and comprises a swinging door 2 and a wall-element 80. The shower-tub is arranged in a corner between two stationary walls or room-walls 10. The wall-element 80 consists of a sheet of glass, with one vertical longitudinal edge in a frame-profiled-rail 11 connected adjustably to a wall-profiled-rail 15 secured to wall 10 of the room. Arranged on the other vertical longitudinal edge of the wall-element 80 is a corner-profiled-rail 36. Finally, located upon the upper edge of the wall-element 80 is a transverse strut 17 which, on the one hand, stiffens the wall-element 80 and, on the other hand, provides a connection between the corner-profiled-rail 36 and the frame-profiled-rail 11. Door 2 also carries such a transverse strut 17.

For the purpose of stabilizing the wall-element 80, a crosspiece 21 is located in the interior, i.e. above the shower-tub 42. The crosspiece 21 bears, with corresponding support-surfaces, on the one hand against the wall 10 of the room and, on the other hand, directly against the inside of the wall-element 80 which is in the form of a sheet of glass. All that can be seen on the front face of the wall-element 80, visible from this angle, is a cover 23 which covers the means of attachment, more particularly screws. The crosspiece 21 is in the form of an angular support and, because of the transparent design of the wall-element, made of glass, it is visible from the outside. The crosspiece 21 is arranged within the upper third of the overall height of the wall-element 80, in order to provide satisfactory stability. The crosspiece 21 is arranged in such a manner that the lower edge 25 thereof lies approximately on a level with the lower edge of an upper hinge 6 on the door 2. Located on the bottom edge of the door 2 is a lower hinge 4. The symmetrical arrangement of the hinges and crosspiece 21 ensures a satisfactory overall optical impression.

Figure 2:
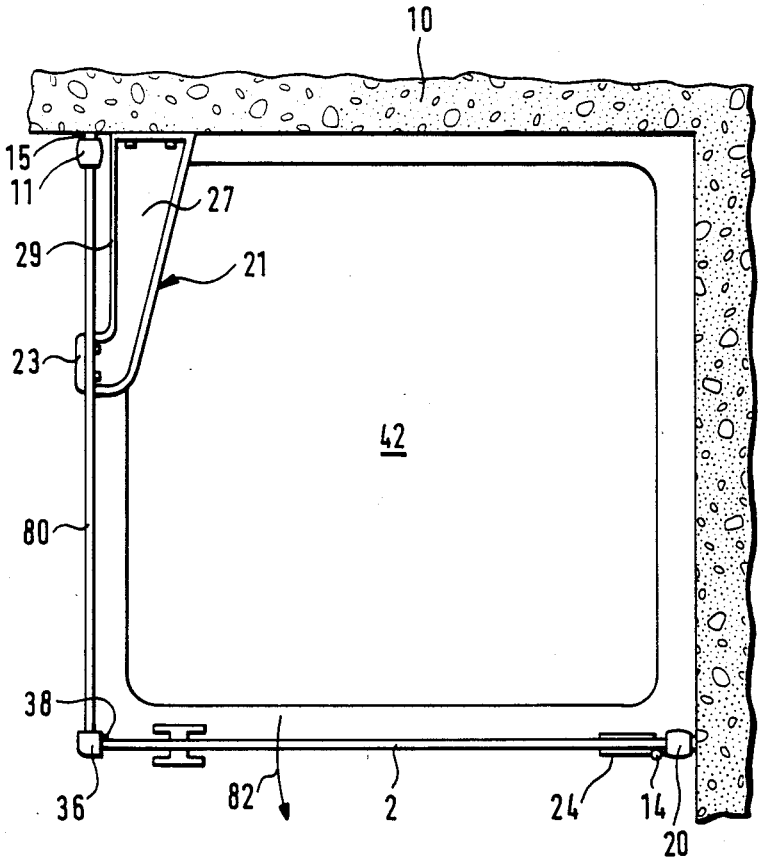
FIG. 2 is a view in the direction of arrow A in FIG. 1.

FIG. 2 is a plan view of the shower-partition, the crosspiece 21, arranged in the interior of the shower above the shower-tub 42, being clearly visible. As seen in a vertical plane, the crosspiece 21 is of approximately U-shaped cross-section, with an edge 29 projecting vertically upwardly from a bottom-plate 27. The edge 29 runs around the entire periphery of crosspiece 21 which is approximately triangular, a high degree of rigidity being achieved, in conjunction with horizontal bottom-plate 27, although both the bottom-plate 27 and the edge 29 are made of a relatively thin material. The crosspiece 21 also serves as a receptacle for soap or the like shower requirements. Arranged at right angles to the wall element 80 is a swing door 2 which is secured, by means of the hinge 6, to a compensating section 20. The upper hinge 6 may be seen here and a hinge 4 of corresponding design is also provided at the lower edge of door 2 as above explained. The upper hinge 6 contains a holder 14 connected to the compensating section 20, and a hinge-arm 24, connected to the door 2, being adapted to pivot about a vertical axis in relation to the holder 14. The door 2 may be swung open in the direction of arrow 82 in order to expose the entrance to the shower located between compensating section 20 and corner-profiled-rail 36.

Figure 3:
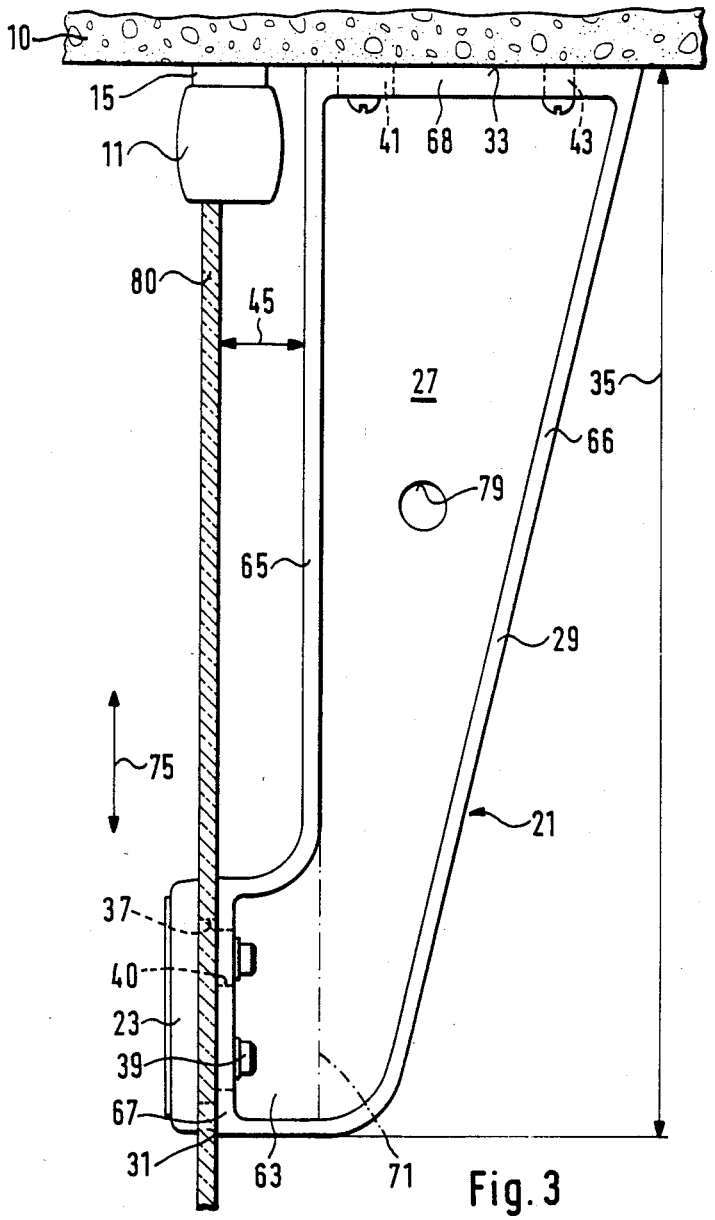
FIG. 3 is a view, to an enlarged scale, of the crosspiece and a part of the wall-element, according to FIG. 2.

FIG. 3 shows the crosspiece 21, to an enlarged scale, the crosspiece being an angular component designed with a first support-surface 31 for wall-element 80. The crosspiece 21 is approximately triangular, the bottom-plate 27 comprising an extension 63 facing the wall-element 80. The first support-surface 31 is designed as the outermost surface of an edge-part 67 which surrounds the extension 63. Two or more such crosspieces may be arranged spaced vertically from each other. The crosspiece 21 also comprises a second support-surface 33 which bears against the wall 10 of the room and is secured thereto. The second support-surface 33 is also a part of the edge 29 surrounding the bottom-plate 27 of the crosspiece. The size of the support-surfaces 31 and 33, especially that of the first support-surface 31, must be such as to avoid high surface-pressures and peak loads in the connecting area.

In order to achieve satisfactory stability, the crosspiece 21 may be made relatively long, for example about 40 cm in length. It should be noted that the wall-element 80 is, in practice, between 80 and 90 cm in width. The first support-surface 31 is located either in or just in front of the central plane of wall-element 80. The latter contains an elongated hole 37, running in a horizontal plane, through which an attachment-element in the form of a screw 39 is screwed in order to connect the wall-element 80 to the crosspiece 21. Alternatively or also additionally, the edge 29 of the crosspiece 21 may also be provided with an elongated hole 40 for the attachment-element 39. These elongated holes provide a simple way of adjusting the wall-element 80 in relation to the crosspiece 21 and vice-versa.

Moreover, the frame-profiled-rail 11 is adjustable in relation to a wall-profiled-rail 15. On the whole, therefore, the invention provides for simple alignment of individual components, thus simplifying assembly. For the same reason, the crosspiece 21 is also adjustable in relation to the wall 10 of the room, to which end it also comprises elongated holes 41,43. The elongated hole 41 runs horizontally while the elongated hole 43 runs vertically, thus making pivoting possible for the purpose of locating the exact horizontal position. The second support-surface 33 of the crosspiece 21 bears against the wall 10 of the room. The crosspiece 21 is arranged between the extension 63 and the wall 10 at a distance 45 from the wall-element 80. A part 65 of the edge 21 runs parallel with the latter in this area. As indicated by a broken line 71, the crosspiece 21 is substantially triangular, although it is bent corresponding to extension 63 and thus forms an angular support. The support-surfaces 31,33 constitute the outer surfaces of the parts 67 and 68 of the edge 29. These parts 67,68, and the support-surfaces 31,33 also, lie in vertical planes which are therefore at right angles to each other. Part 66 of the edge 29, which extends farthest into the interior above the shower-tub, is arranged at an acute angle opening towards the wall 10 of the room in relation to part 65. In assembling the shower-partition, the wall-profiled-rail 15 and the crosspiece 21 are initially secured to wall 10 in the usual manner by means of dowels or the like, the wall-profiled-rail 15 being set up exactly vertically whereas the crosspiece 21 is initially secured to wall 10 only provisionally, by means of screws inserted into elongated holes 41,43. The wall-element 80 is then set up vertically and is secured to the crosspiece 21 by screws 39 which are merely indicated. The horizontal arrangement of elongated hole 37 in the sheet of glass of the wall-element 80, and/or that of the elongated hole 40 in the edge-part 67, make it possible to align the wall-element 80 in the direction of double-arrow 75. The crosspiece 21 is then secured to the wall 10 and the wall-element 80 by tightening the screws. A cap 23 is used to cover screws 39. Water can flow away through an opening 79.

Figure 4:
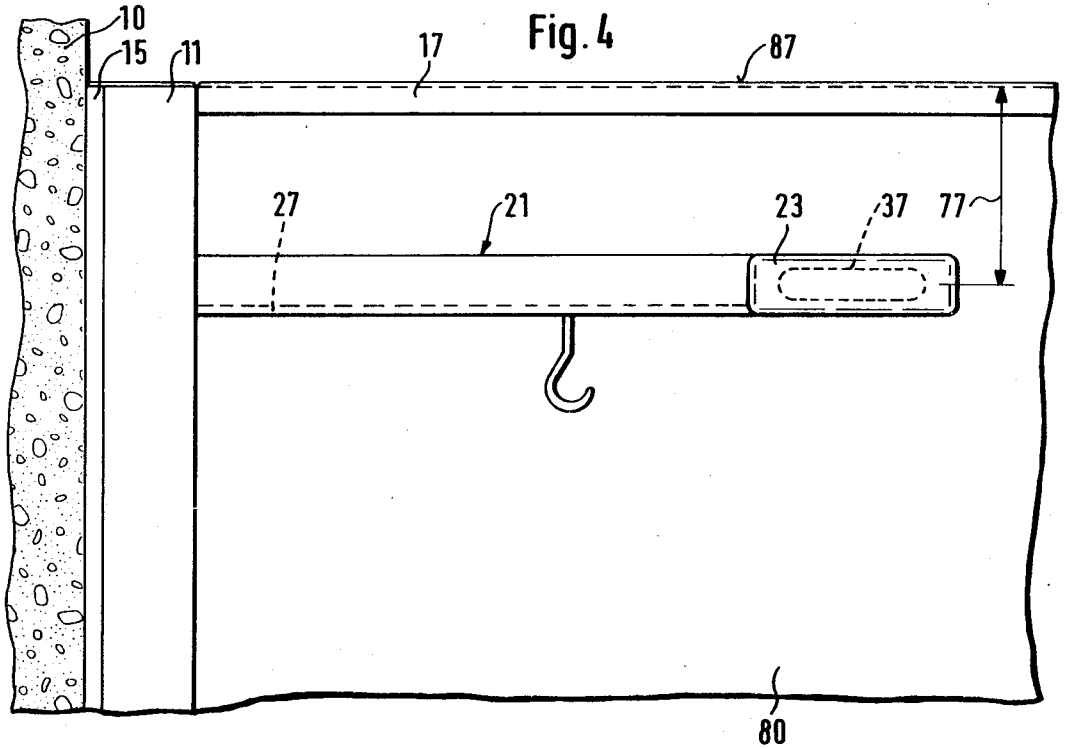
FIG. 4 is a view in the direction of arrow B in FIG. 1.

FIG. 4 shows in part, and to an enlarged scale, a view in the direction of arrow B in FIG. 1 of the wall-element 80, made of a safety glass, behind which the crosspiece 21 is clearly visible. Arranged upon the upper edge of the wall-element 80 is a transverse strut 17, while the profiled-rail 11 and the wall-profiled-rail 15 are arranged upon the vertical longitudinal edge. The bottom-surface of the crosspiece 21, located behind the plane of the drawing, is shown by a broken line. The cover 23 is attached to the front of the wall-element 80 by means of an adhesive or clips. Also provided in the bottom-plate 27 is a hook from which shower-equipments may be suspended. Attachment is by means of a screw or clip. Elongated hole 37, running horizontally, is indicated by a broken line and is arranged at a distance 77 from the upper edge 75 of the wall-element 80. This distance 77 ensures that the elongated hole 37 can easily be made in wall-element 80 while the latter is being produced. The elongated hole 37 is made in wall-element 80 at the plant, so that no more holes need be drilled on-site during assembly.

FIG. 5 shows a cross-section along line V—V in FIG. 1, with the wall-element 80 and the door 2 reversed in relation to each other. The rounded legs of the frame-profiled-rail 11 engage over the wall-profiled-rail 15 which is arranged substantially in the interior and which is secured by means of screws to the wall 10 of the room. At least two screws, spaced from each other vertically, are provided for connecting rail 11 to rail 15 adjustably, the screws passing through a slot 49, running at right angles to the wall of the room, in the relevant leg of the wall-profiled-rail 15. Located in the interior of wall-profiled-rail 15 is a clamping-element 51 through which screws 47 also pass, the clamping element also comprising a nut 53 for screws 47. In its surface supported on the legs of wall-profiled-rail 15, the clamping element 51 is provided, like the latter, with vertical serrations 55, i.e. serrations running at right angles to the plane of the drawing. It will be seen that by loosening screws 47, the frame-profiled-rail 11 may be adjusted in the direction of arrow 57 in relation to the wall-profiled-rail 15. Since the wall-element 80 is also adjustable, in relation to the crosspiece 21 secured to the wall 10 of the room, by means of the elongated holes 37,40 mentioned hereinbefore, and may therefore be aligned, assembly is a simple matter. The slot 49, open towards the end of the leg makes it a simple matter to push frame-profiled-rail 11 onto wall-profiled-rail 15 after the latter has been secured to wall 10 of the room.

The frame-profiled-rail 11, and the corner-profile 36 accordingly, each contain a recess into which plastic profiles 59 are inserted. These are of approximately U-shaped cross-section and are provided with arms for mounting wall-element 80 which is made of safety-glass. Moreover, in order to obtain resilient sealing, a sealing strip 61, made of rubber or some comparable material, is provided. The corner-profile 36 also contains a stop-section 38 for the door 2. The stop-section comprises, on the one hand, a sealing lip 84 bearing sealingly against the inside of the door 2 and, on the other hand, a resilient seal 86 associated with the end-face of the door.

Although, the invention was described hereinabove with a certain degree of particularity, it is understood that the present disclosure has been made only by way of example and that numerous changes in the details of construction and the combination and arrangement of parts may be resorted to without departing from the spirit and the scope of the invention as hereinafter claimed.

I claim:

1. A shower partition comprising a wall-element and adapted to be secured thereby to a wall of a room, said shower-partition further comprising:

a crosspiece having a horizontally arranged bottom-plate, and vertical edge-parts arranged upon said bottom-plate, a first of said edge-parts comprising a first vertical support-surface facing said wall-element, and a second of said edge-parts comprising a second vertical support-surface facing said wall of the room, said wall-element comprising an elongated hole through which is passed a connecting element for connecting said wall-element to said crosspiece;

said crosspiece comprising a peripheral edge comprising said first and second edge-parts with said support-surfaces;

said wall-element having a first vertical longitudinal edge which is arranged adjustable against the wall of the room by means of a frame-profiled-rail and a wall-profiled-rail;

said frame-profiled-rail being connected by means of a transverse strut to a corner-profiled-rail which is arranged, at a second vertical longitudinal edge of the wall-element, opposite said first vertical longitudinal edge, said crosspiece being secured below the upper edge of said wall element, and said bottom-plate being substantially triangular in shape and comprising an extension, also lying in the horizontal plane, which points towards said wall-element and comprises said first edge-part with said first support-surface against which said wall-element bears directly.

2. A shower-partition according to claim 1, wherein said crosspiece comprises a third edge-part which is arranged substantially parallel with said wall-element at a predetermined distance therefrom and extends between said wall of the room and said extension.

3. A shower-partition according to claim 2, wherein said crosspiece comprises, in the vicinity of the second support-surface, at least one elongated hole for the purpose of alignment in relation to said wall of the room.

4. A shower-partition according to claim 3, wherein in the vicinity o said second support-surface, there are two of said elongated holes, one of said elongated holes being arranged horizontally while the other elongated holes being arranged vertically.

5. A shower-partition according to claim 4, wherein said crosspiece is in the form of a receptacle for soap, and wherein said peripheral edge projects vertically upwardly beyond said bottom-plate.

6. A shower-partition comprising a glass wall-element and adapted to be secured thereby to a wall of a room, said shower-partition further comprising:

a crosspiece comprising a first support-surface adapted to be secured to said glass wall-element, and a second support-surface adapted to be secured to said wall of the room;

said glass wall-element having a transverse aperture therethrough, and said first support surface of said crosspiece having an aperture therethrough which at least partially registers with said transverse aperture of said wall element;

a connecting element extending through said transverse aperture of said glass wall-element and through said aperture of said first surface of said crosspiece to fix said glass wall-element to said crosspiece;

wherein, at least one of said transverse aperture of said glass wall-element and said aperture of said first surface of said crosspiece is an elongated slot for facilitating positional adjustment of said glass wall-element with respect to said wall of the room;

said first and said second surfaces are vertical and at right angles to each other;

said glass wall-element has a first vertical longitudinal edge which is arranged adjustably against the wall of the room by means of a profiled-rail called frame-profiled-rail;

said frame-profiled-rail is arranged against said wall of the room by means of a further profiled-rail, called wall-profiled-rail, which is secured to said wall of the room, a clamping element having vertical serrations being provided inside said glass wall-profiled-rail, said frame-profiled-rail adjustably engaging over said wall-profiled-rail, said wall-element being adjustable with respect to said crosspiece, a slot provided in said wall-profiled-rail permitting the pushing of said frame-profiled-rail onto said wall-profiled-rail after said wall-profiled-rail has been secured to the wall of the room; and a corner-profiled-rail is arranged at a second vertical longitudinal edge of the glass wall-element opposite said first vertical longitudinal edge, and said corner-profile is provided with a stop-section comprising a sealing lip bearing sealingly against an inside surface of an adjacent swinging door and a resilient seal which bears against an end-face of said door when said door is closed.

* * * * *